US005154235A

United States Patent [19]

Renaker, Jr. et al.

[11] Patent Number: 5,154,235

[45] Date of Patent: Oct. 13, 1992

[54] METHOD FOR CONTROLLING AND SUPPRESSING FIRES USING DEALGINATED, DEWATERED KELP WASTE

[75] Inventors: John J. Renaker, Jr., Valley Center; Donald A. Magley; Michael R. Bustamante, both of Chula Vista, all of Calif.

[73] Assignee: Damcosur S.A. De C.V., Chula Vista, Calif.

[21] Appl. No.: 790,755

[22] Filed: Nov. 12, 1991

[51] Int. Cl.[5] ..... A62C 3/00; A62C 2/06

[52] U.S. Cl. ..... 169/46; 169/48; 428/920; 428/921; 252/2

[58] Field of Search ..... 169/46, 47, 48, 43; 252/2, 601, 606, 378 P; 428/920, 921

[56] References Cited

U.S. PATENT DOCUMENTS

| | | | |
|---|---|---|---|
| 2,340,370 | 2/1944 | Doyle | 252/2 |
| 3,975,277 | 8/1976 | Pierrou | 252/2 |
| 4,197,913 | 4/1980 | Korenowski | 169/46 |
| 4,248,733 | 2/1981 | States | 169/47 |
| 4,606,832 | 8/1986 | Hisamoto et al. | 169/46 |
| 4,616,711 | 10/1986 | Johnson | 169/46 |
| 4,665,993 | 5/1987 | Balassa | 169/47 |
| 4,763,731 | 8/1988 | Adams et al. | 169/46 |
| 4,897,207 | 2/1990 | Greene | 169/46 |
| 5,009,790 | 4/1991 | Bustamante et al. | 210/689 |

*Primary Examiner*—Margaret A. Focarino
*Assistant Examiner*—James M. Kannofsky
*Attorney, Agent, or Firm*—Brown, Martin Haller & McClain

[57] ABSTRACT

A method is described for the control or suppression of a fire in which one applies to the fire a suppressant material which contains dealginated, partially dewatered kelp. Other components, such as perlite, may also be present. The suppressant material will have a water content no greater than about 25%, preferably about 5%-10%. It is used in the form of particulates and applied to the surface of a fire to suppress or extinguish the fire. It is particularly applicable to fighting fires in remote or inaccessible locations; large area fires, such as pools of burning oil; or fires where use of conventional water fire fighting methods are either dangerous or insufficient. The material may be molded into various shapes adapted to be used as fire barriers in vehicles and building walls.

15 Claims, 1 Drawing Sheet

METHOD FOR CONTROLLING AND SUPPRESSING FIRES USING DEALGINATED, DEWATERED KELP WASTE

BACKGROUND OF THE INVENTION

1. Field of the Invention

The invention herein relates to methods for the control and suppression of fires, particularly those in which the fire is spread over a substantial area.

2. Description of Prior Art

There are many different types of fires which are difficult or impossible to fight in the conventional manner, such as by using water sprays and streams. For instance, many types of fires such as brush fires occur in locations which are not readily convenient to water supplies or where the terrain is such that it is difficult to bring available water to bear on the fire. Similarly, when fires occur in confined locations or indoors, such as in a factory or warehouse, the use of water for fire suppression may be dangerous or inappropriate, either because it will cause the burning material to spread to nearby areas or the water itself may cause damage to surrounding equipment and products.

There are also types of fires where water is not a satisfactory fire suppressant, either because it reacts with the burning material or because it cannot effectively suppress the fire. For instance, oil well fires and fires in burning pools of oil and other petroleum products are not readily susceptible to suppression with water streams and water sprays.

Further, water and similar liquid fire suppressants cannot normally be used to form fire barriers in permanent positions. For instance, it is desirable (and often required) that in certain types of vehicles there be a permanent fire suppressing barrier between the engine compartment and the passenger compartment. This barrier is intended to control a fire which occurs in the engine compartment and either prevent it from passing through into the passenger compartment or at least to retard the fire for a sufficient period that the occupants of the passenger compartment can escape from the vehicle before the fire reaches the passenger compartment. Water and other liquids, even if in a suitable container formed in the shape of a barrier, will often fail at the critical moment, such as in a road accident in which the container is damaged so that the liquid runs out at exactly the time that a fire is starting in the engine compartment from the accident. Consequently, just when such a barrier is most needed, the liquid has escaped and the barrier is rendered useless.

Over the years there have been a wide variety of solid materials which have been used for fire suppressance. As an example, in U.S. Pat. No. 4,665,993 is described the use of water-containing cellulosic fiber mats made from materials such as corn cobs, corn stalks, straw, cane, dry leaves and cardboard. These mats are saturated with water in a water: fiber ratio range of 1-50;1, based on weight of water per unit weight of the cellulosic material. Thus the devices of this patent are in effect merely an alternative way of delivering quantities of water to the fire site and of course require that there be a convenient source of water present to saturate the cellulosic mats before they are applied to the fire.

We have previously described use of dealginated, partially dewatered kelp waste for the purpose of absorption of oil and other waste liquids in our U.S. Pat. No. 5,009,790.

It would be very desirable for fire fighters to have available a convenient, low cost, effective, environmentally safe material which could be used for the suppression, control or extinguishing of fires under a wide variety of conditions or in areas where ordinary suppression means such as water streams and sprays are either ineffective, unavailable or dangerous to use.

SUMMARY OF THE INVENTION

The invention herein is a method for the control or suppression of a fire which comprises applying to the fire a suppressant material which comprises dealginated, partially dewatered kelp. The suppressant material useful in this invention often contains other components in addition to the dewatered, dealginated kelp, commonly perlite. The suppressant material useful in this invention will have a water content no greater than about 25%, preferably in the range of about 5%-10%. (All percentages herein are by weight unless otherwise specified.)

The suppressant material will preferably be granulated into particles, such as flakes, powders or granules, and in such forms may be applied in a variety of different manners to the fire to be controlled or extinguished. Alternatively, the suppressant material may be formed into solid blocks in a variety of different shapes, and in such shapes may serve as fire barriers and fire walls in such locations as vehicles and buildings.

The invention is particularly useful in the fire control or suppression of burning liquids, especially burning oil products.

DETAILED DESCRIPTION AND PREFERRED EMBODIMENTS

Figure 1:
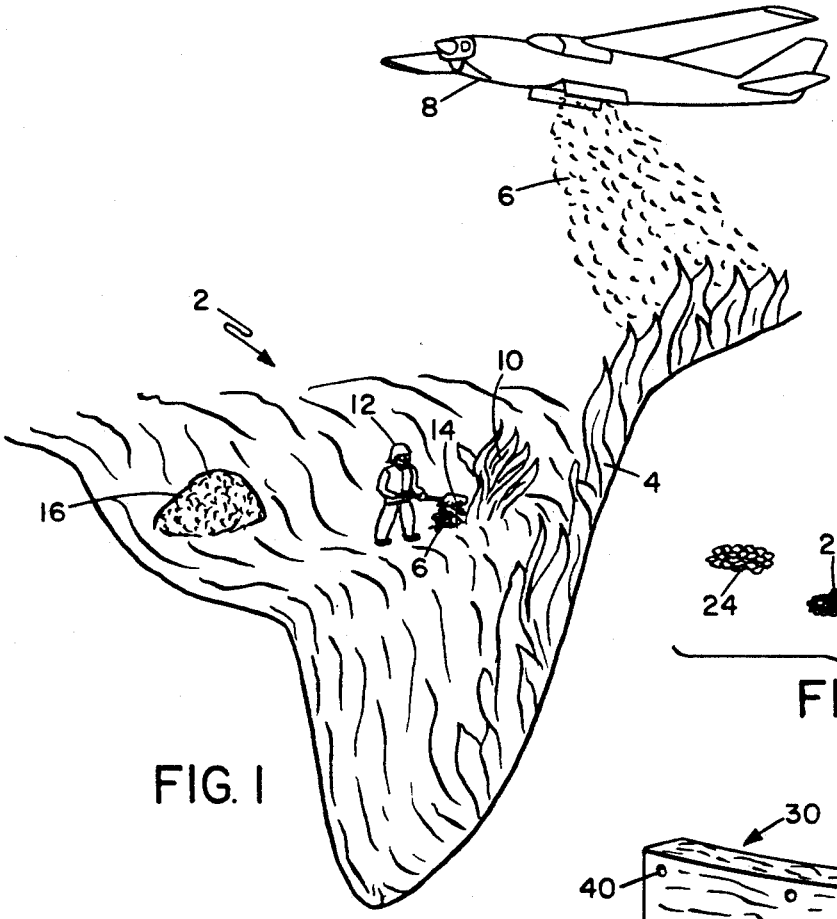
FIG. 1 is a schematic representation of the method of this invention being used to suppress a brush fire in a deep canyon.
Figure 2:
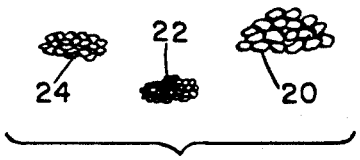
FIG. 2 illustrates schematically several representative configurations of the suppressant material useful in this invention.

The method of this invention will be described below in detail in conjunction with the description of the various FIGURES of the drawings. That description will be best understood, however, by first considering the detailed description of the suppressant material used in the present invention.

The critical element in the method of the present invention is the use of dealginated, partially dewatered kelp as the principal suppressant material. Kelps are plants of the order laminariales. They are ocean plants, growing along shore lines in kelp beds. They commonly grow 100-200 ft. (30-60 m) in length and form what has been aptly described as "an underwater forest." Kelps are described in detail in Cronquist, *Introductory Botany*, 197-199 (1961).

The kelp plants are harvested by specially designed boats which cut off the tops of the kelp plants floating at the ocean surface. The collected cuttings are then brought to shore based chemical plants where the kelp is subjected to a variety of chemical reactions intended primarily to extract algin and algin based chemicals (alginates) from the kelp. Such processes have been used for many years and are widely described in the literature; see e.g. U.S. Pat. Nos. 1,814,981 to Thornley et al. and 3,773,753 to Wright et al. After the alginate is removed from the kelp, there is left a residue which is commonly referred to as cellular debris of the kelp (see the aforesaid Thornley et al. patent). This material is generally in the form of a wet pulpy mass, commonly containing as much as 85% or 90% water, with the remainder being the dealginated kelp debris and, in some cases, additional materials used in the kelp processing. (These latter materials are often advantageous in the present invention.) The extracted algin materials are sent on for further chemical processing not relevant to the present invention.

The exact composition of the pulpy material discharged from the kelp processing operations is variable and all specific components are not known to the inventors. For the purposes of the present invention, however, it is sufficient merely to describe it as kelp from which the algin components have been removed, leaving whatever botanical and cellular residue remains. The limited variation of composition is expected, since kelp, being a natural material and found under a variety of environmental conditions in different oceans of the world, can be expected to show some natural variation in composition, as indicated in the aforementioned Cronquist text.

To be suitable for use in the present invention the kelp residue discharged from the algin extraction process must be substantially dewatered, to bring the water content of the overall suppressant material down to a maximum of about 25%, and preferably down to about 5% to 10%. This can be done by any of a number of drying techniques, including spreading the kelp residue (with any included materials, such as perlite) in a thin layer over a large surface area so that it can be air dried and sun dried; by subjecting the kelp residue to a mild heat treatment (with air or gas temperature not being so high that the kelp residue becomes damaged), as for instance by placing the kelp in conventional drying units which have several tiers of porous platforms; and by similar drying techniques well known to those skilled in the art. It is possible to dry the kelp residue to a water content of less than about 5%, but for the purpose of the present invention such is unnecessary. Since the waste kelp may be readily dried to a water content in the range of 5% to 10%, and drying below that level becomes increasingly more difficult and expensive without any significant gain in the suppressant properties, it is preferred that the minimum water content be in the range of 5% to 10% for the suppressant material.

During the processing of kelp by the primary kelp collector and processor, it is common for other materials such as filter aids to be used and to be discarded with the kelp residue. Common among such materials which may be found in the kelp residue is perlite. Perlite is a glassy material, generally of volcanic origin. When heated it expands explosively (much in the manner of popcorn) to form a very low density granular material exceptionally well suited for use as a filter aid. The nature, properties, processing and use of perlite is conventional and widely described; see, for instance, Chesterman, "Perlite," in Lefond, ed., *Industrial Minerals and Rocks*, 927–934 (4th edn., 1975). For the purposes of the present invention the presence of the perlite is advantageous, since it is not flammable and has some thermal insulation value which helps to suppress and control the fire. It also helps provide buoyancy when the process of this invention is used to suppress fire in a pool of burning liquid. The amount of perlite which may be present in association with the cellular kelp debris is not critical as long as it is not so great that the functioning of the kelp residue component is impaired. Normally, the amount of perlite present will be no greater than the amount of plant residue and normally will be somewhat less, if present at all.

During or after dewatering the "kelp waste" (which term is hereafter used for brevity to mean the composite suppressant material including the kelp plant residue, the remaining water content and the associated materials such as perlite, if any) is preferably granulated into particles of different sizes, including flakes 20, powders 22, granules 24 and the like. It is preferred that the particle size not be so small that the material becomes too dusty and possibly airborne to too great a degree. Particle sizes on the order of the size of sand grains or larger are quite satisfactory. ("Fine sand" particles have a minimum particle size of about 20 μm, while "coarse sand" particles have a minimum particle size of about 200 μm; Perry et al., *Chemical Engineers's Handbook*, 5th ed. [1973], FIG. 20–92.)

The use of the kelp waste for fire suppression in accordance with the process of this invention can now be illustrated by reference to the drawings. FIG. 1 illustrates a typical remote or difficult fire scene, in this case exemplified by a deep narrow canyon 2 at the bottom of which is burning a brush fire 4. This is unfortunately a very common occurrence in many areas such as the foothills and canyons of Southern CA. Typically the location such as canyon 2 is at least several miles from the nearest convenient source of water and the topography of the area is commonly such that even when water is available, pumper trucks and hose lines cannot be positioned to bring the water streams to bear on the fire.

A similar type of situation would be present where, for instance, the fire is in a open area where a large pool of flammable material such as crude oil is burning. Typical of such a situation would be the oil well fires in Kuwait which resulted from the sabotage during the Persian Gulf War. It is widely known that many of these wells are surrounded by large pools of crude oil which have escaped from the damaged wells and which themselves have become ignited. Often these wells are in the desert far from any water source and the burning pools of oil surrounding the wells prevent fire fighters from close approach to the well heads themselves. Also, many of the pools are of sufficient size that even if water were available, it would be difficult to provide sufficient pumping force to create water streams which could reach form the perimeter of the pools into the central section to cover all the burning oil surface.

In FIG. 1 is illustrated an air drop of the kelp waste suppressant material 6 from a supply aircraft 8. It is recognized that fires create significant updrafts and wind forces on their own, which must be considered in planning such air drops. The particle size of the kelp waste will be chosen such that the particles have sufficient weight to drop through the updrafts onto the desired target area of the fire. Techniques for dropping aerial suppressants such as water or borate slurries from tanker planes over brush and forest fires, with their attendant updrafts, are well known and highly developed by pilots from many fire fighting organizations, and these techniques are relevant here. Thus, by appropriate selection of the particular particle size of the kelp waste to be used and use of flight patterns which counteract the updrafts, those skilled in the art will readily understand how to ensure that the kelp waste suppressant is dropped onto the fire at the desired locations.

FIG. 1 also illustrates fire fighting of individual small hot spots such as shown at 10. Here a fire fighter 12 is shown depositing the suppressant material 12 onto a fire hotspot 10 by throwing the suppressant material from a shovel 14. A small pile of suppressant material 16 is provided adjacent to the fire fighter to provide supply of suppressant material sufficient to control or extinguish the hot spot 10. The supply 16 of the kelp waste material can be provided from a dump truck, pickup truck, or similar vehicle if vehicle access to the vicinity of the hot spot is possible or bags of suppressant material can be carried to the vicinity by supply crews or dropped in from helicopters.

Aerial drops will also be highly effective with respect to combating large burning pools of material such as the Kuwait crude oil pools described above. In fact, large aircraft and large quantities of the kelp waste can be used for individual drops, because in many instances (such as in Kuwait) the surrounding areas are quite flat and the aircraft can approach burning material from a variety of different directions so that the optimum approach paths and suppressant drops can be utilized. The same will be true if the burning material is afloat on the surface on a body of water, such as an oil pool which has leaked from a damaged tanker onto the ocean surface or a harbor surface and has become ignited.

Figure 4:
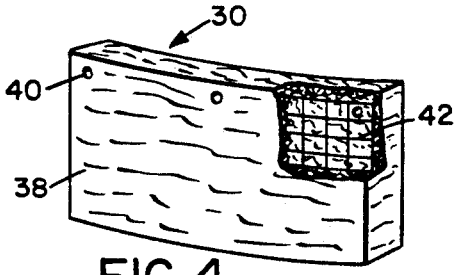
FIG. 4 is a detailed view, also partially in cut-away, of the molded fire barrier shown in FIG. 3.
Figure 3:
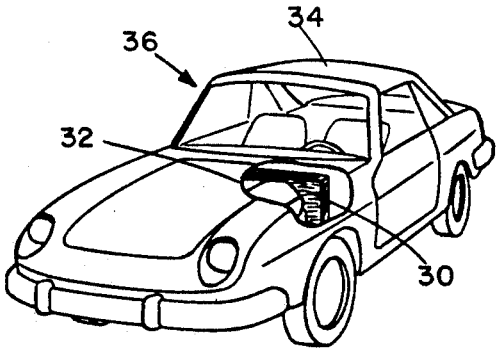
FIG. 3 illustrates, partially in cut-away, the suppressant material of this invention in the form of a molded fire barrier in a vehicle.

Another aspect of the present invention is illustrated in FIGS. 3 and 4. In all vehicles it is highly desirable to have a fire retardant shield or barrier 30 disposed between the engine compartment 32 and the passenger compartment 34 of the vehicle (here designated 36). Thus if an engine fire occurs, either spontaneously or as a result of a road accident, the occupants of the passenger compartment will be afforded a period of time to escape from the vehicle 36 before the fire in the engine compartment reaches the passenger compartment. Not only are such barriers 30 desirable in all vehicles, but in fact in many vehicles they are required by safety laws or regulations. Typical are fire shields in various types of trucks and racing vehicles. The present invention lends itself very well to the production of such barriers, since the kelp waste can be molded and dried in a variety of configurations, such that barriers can be prepared which precisely fit the contours of various vehicles. Of course, such molded barriers can also be used in portions of the vehicle other than at the wall between the engine compartment and the passenger compartment, such as being used as hood liners or a shield in areas surrounding the fuel tanks.

A typical vehicle barrier is shown schematically in FIG. 4. The kelp waste material is molded into the desired shape to form a block 38 which can, if desired, be provided with openings 40 for mounting bolts or other means of securing the barrier 30 to the vehicle in the desired location. It is contemplated that adhesives may also be used, but because the molded material generally has a fairly irregular surface because of the nature of the kelp waste, a careful selection of adhesives will be necessary in order to insure that the barrier 30 becomes properly bonded to the metal surface of the vehicle. Supplemental bolts are usually desirable. However, those skilled in the art and familiar with various types of adhesives will be readily to determine suitable adhesives for such use.

The barrier 30 shown in FIG. 4 may also contain an internal mesh as of steel mesh, fiberglass mesh, or the like at 42. The kelp material is commonly molded around the mesh 42 so that the mesh is embedded in the block 38. Such meshes are commonly used by themselves in vehicles such as racing vehicles as a safety mesh in the event of an accident. The mesh barrier serves to prevent dislodged parts of the engine and other underhood components from being thrown into the passenger compartment where they could cause serious injury to drivers and passengers, and also reinforces the molded kelp waste barrier. By incorporating such mesh 42 into the block 38 of barrier 30, the barrier 30 becomes a dual purpose shield which not only retards fire from entering the passenger compartment, but also can retard or prevent dislodged objects from being thrown into the passenger compartment.

Figure 5:
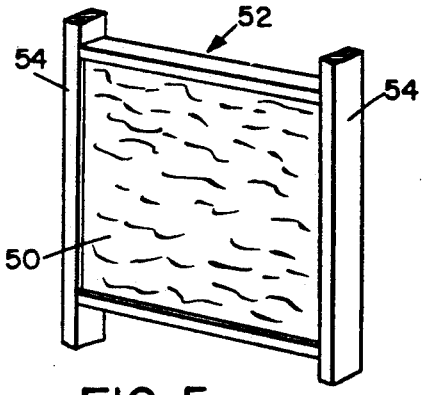
FIG. 5 illustrates, partially in cut-away, the suppressant material of this invention in the form of a molded fire barrier in a building.

Similarly, as shown in FIG. 5, the kelp waste material used in this invention can be molded into blocks, slabs and similar shapes and used as fire barriers in building wall construction. Here a block 50 is shown emplaced in a wall 52 between studs 54. If the block 50 is cut to the appropriate dimensions, it can be force fitted between the studs 54 and no nails, adhesive or other means are needed to secure the block 50 into position until the wall facing or wall board is put into place. Alternatively, securing means such as nails can be used to hold the block 50 in position. Blocks 50 can be molded to various shapes to fit in any oddly shaped recesses, corners, and like areas in a wall structure.

It will be evident to those skilled in the art that there are numerous embodiments of this invention which, while not expressly set forth above, are clearly within the scope and spirit of the invention. Therefore the above description is to be considered exemplary only, and the actual scope of the invention is to be defined solely by the appended claims.

We claim:

1. A method for the control or suppression of a fire which comprises applying to the fire a suppressant composition which comprises dealginated, partially dewatered kelp.

2. A method as in claim 1 wherein said composition also comprises perlite.

3. A method as in claim 1 wherein said composition has a water content not greater than 25% by weight.

4. A method as in claim 3 wherein said composition has a water content in the range of about 5%–10% by weight.

5. A method as in claim 1 wherein said suppressant composition is granulated into particles.

6. A method as in claim 5 wherein said particles are in the form of flakes, powders or granules.

7. A method as in claim 1 wherein the material which is burning is a petroleum material.

8. A method as in claim 7 wherein said petroleum material is a crude oil or refined petroleum product.

9. A method as in claim 8 wherein said refined petroleum product is gasoline, naphtha, kerosene or lubricating oil.

10. A method as in claim 1 wherein said dealginated, partially dewatered kelp is molded into a three dimensional body.

11. A method as in claim 10 wherein said body is in the shape of a block or slab.

12. A method as in claim 10 wherein said molded body is adapted to fit into a wall structure of a building and to form a fire barrier therein.

13. A method as in claim 10 wherein said body is in a specially designed shape adapted to fit in a specific location.

14. A method as in claim 13 wherein said location is in a vehicle.

15. A method as in claim 14 wherein said body is adapted to form a fire barrier between the engine compartment and the passenger compartment of said vehicle.

* * * * *